US006205994B1

(12) United States Patent
Freund et al.

(10) Patent No.: US 6,205,994 B1
(45) Date of Patent: Mar. 27, 2001

(54) SCRIBER ADAPTER PLATE

(75) Inventors: Joseph Michael Freund, Fogelsville; George John Przybylek, Douglasville; Dennis Mark Romero, Allentown; Raymond Frank Gruszka, Reading, all of PA (US)

(73) Assignee: Lucent Technologies, Inc., Murray Hill, NJ (US)

( * ) Notice: Subject to any disclaimer, the term of this patent is extended or adjusted under 35 U.S.C. 154(b) by 0 days.

(21) Appl. No.: 09/219,783

(22) Filed: Dec. 23, 1998

(51) Int. Cl.[7] ..... B28D 3/00
(52) U.S. Cl. ..... 125/23.01; 225/103; 225/104
(58) Field of Search ..... 225/103, 104; 125/23.01

(56) References Cited

U.S. PATENT DOCUMENTS

| | | | | |
|---|---|---|---|---|
| 4,095,344 | | 6/1978 | Loomis . | |
| 4,653,680 | | 3/1987 | Regan | 225/104 |
| 5,104,023 | * | 4/1992 | Nishiguchi et al. | 225/103 |
| 5,769,297 | * | 6/1998 | Loomis et al. | 225/103 |
| 5,820,006 | | 10/1998 | Turner | 225/96 |
| 5,979,728 | * | 11/1999 | Alfaro | 225/103 |

* cited by examiner

*Primary Examiner*—M. Rachuba
(74) *Attorney, Agent, or Firm*—Dickstein Shapiro Morin & Oshinsky LLP

(57) ABSTRACT

A scribing machine adapter plate is configured to receive and couple a hoop assembly to a chuck on a scribing machine. The adapter plate includes an upper surface and an inner annular vacuum groove and an outer annular vacuum groove formed in the upper surface. A third vacuum groove extends radially between, and communicates with, the inner and outer grooves. The outer vacuum groove includes a vacuum inlet hole that extends from the groove through the adapter plate to provide communication between a vacuum channel in the chuck and the vacuum grooves in the plate. The polymer film of the hoop assembly is disposed on the upper surface to seal the vacuum grooves to hold the film in place during scribing of materials placed on the film.

5 Claims, 3 Drawing Sheets

SCRIBER ADAPTER PLATE

BACKGROUND OF THE INVENTION

1. Field of the Invention

The present invention relates generally to methods and apparatus for scribing and breaking semiconductor devices into individual dies. In particular, the invention relates to scribing machines that use a hoop and film assembly to support the semiconductor devices in position beneath a scribing tool. More particularly, the invention relates to adapter plates for receiving and supporting the hoop and film assembly and limiting the movement of the film relative to the scribing tool.

2. Description of the Related Art

In the manufacture of microelectronic devices such as semiconductor lasers, many lasers are fabricated on a single bar. The bar is separated into individual lasers using semiconductor scribing and breaking equipment.

Semiconductor scribing equipment includes sharp pointed scribes. The scribes are drawn across the surface of the bar to scribe a line or lines along which the bar is eventually broken into individual lasers. Examples of semiconductor scribing and breaking equipment are shown in U.S. Pat. No. 5,820,006, U.S. Pat. No. 4,653,680, and U.S. Pat. No. 4,095,344, the entire disclosures of which are incorporated herein by reference.

In the apparatus disclosed in U.S. Pat. No. 5,820,006 and U.S. Pat. No. 4,653,580 a wafer-holding chuck is motor driven in an X direction and a Y direction and rotates about an axis perpendicular to the X and Y directions. At a scribing station, a scribe module is mounted above the wafer-holding chuck. An impulse bar with a straight sharp upper edge is mounted beneath the wafer-holding chuck and is carried along with the chuck. During scribing, the chuck carries a wafer to the scribing station at which time the upper sharp edge of the impulse bar rises to apply force against the bottom surface of the wafer along a line in the X direction and place the top surface of the wafer in tension. While the top surface is under tension, the wafer is moved relative to the scribe in the X direction to scribe the wafer in a line directly above the elongated sharp edge of the impulse bar. After the first scribe line is completed, the wafer is moved a predetermined distance in the Y direction and the wafer is scribed again along a line parallel to the first scribe line. When all of the desired X direction scribe lines are scribed, the chuck is rotated 90°. The process is repeated, thereby providing a plurality of scribe marks in the X and Y directions. The scribe marks in the X and Y directions cooperate to define a plurality of individual dies.

Subsequent to scribing, the chuck transports the wafer to a breaking station where an anvil is moved to a predetermined distance above the wafer. The chuck positions the first scribe line above the sharp edge of the impulse bar and below the anvil. Once positioned, the impulse bar and is forced upwardly to pinch the wafer scribe line between the anvil and the sharp edge of the impulse bar, breaking the wafer along the scribe line. The wafer is moved a predetermined distance in the Y direction to align the next scribe line between the anvil and the impulse bar, and the breaking process is repeated. When the wafer is broken along all of the X direction scribe lines, the chuck is rotated 90° and the process is repeated to break the wafer along the Y direction scribe lines.

In conventional equipment such as that disclosed in the '006 and '580 patents, a thin adhesive polymer film is stretched over a support ring, commonly referred to as a hoop assembly, and a wafer to be scribed is mounted on the adhesive film. The hoop assembly includes an inner hoop and an outer hoop that snaps over the inner hoop. The film is first stretched over the inner hoop and the outer hoop is then placed over the film and snapped in place, with the film being gripped between the two hoops.

In conventional operation, the hoop assembly is mounted on a chuck. The compliant film serves to seal a vacuum channel formed in the chuck and mechanically isolate the wafer from the vacuum ring and other surrounding rigid structures. The vacuum channel serves to retain the film and the wafer in position relative to the scribe.

This equipment is adequate for scribing and breaking wafers because the wafers are relatively large and rigid. Even though the wafers are mounted on a compliant surface, any movement due to the compliance of the film is within the required tolerances. Thus, the wafer can be positioned relative to the scribing tool, within required tolerances, by controlling the movement of the chuck.

The above-described equipment has been used to scribe wafers containing many types of semiconductor structure, including wafers containing semiconductor lasers. When semiconductor lasers are involved a wafer may contain many individual lasers which are to be separated. Typically, as many as 30 lasers are formed on a laser bar that measures only 12 mils wide by 300 mils long by 4 mils thick. Thus, each individual laser measures about 12 mils by 10 mills by 4 mils. Because the lasers are so small, the tolerances involved in scribing and breaking the lasers from the wafer are very tight. Unfortunately, sometimes the polymer film creeps slightly over the course of the scribing process, resulting in scribe lines that are out of tolerance for the lasers. As a consequence of imprecise scribing, many potential lasers are unusable and wasted.

SUMMARY OF THE INVENTION

The present invention overcomes the above-cited disadvantage by providing additional surface area for supporting the film and by using two vacuum grooves. A preferred embodiment of the invention includes an adapter plate for receiving and supporting a hoop assembly on a vacuum chuck. The adapter plate includes an inner annular vacuum groove disposed adjacent a central aperture and an outer annular vacuum groove. A third vacuum groove extends radially between, and communicates with, the inner and outer annular vacuum grooves. The outer vacuum groove includes a vacuum inlet hole that extends from the groove through the adapter plate to provide communication between the chuck and the vacuum grooves in the disk. The polymer film of the hoop assembly is disposed on the adapter plate so that the polymer film seals the vacuum grooves, thereby holding the film to the plate.

The additional surface area includes the portion of the top surface of the adapter plate that is disposed between the two vacuum grooves. The top surface is polished, causing the film to wet, via surface tension, to the plate, thereby reducing movement of the film. The addition of a second vacuum groove, in this case the inner vacuum groove, moves the hold down vacuum in closer to the work area, which further reduces movement of the film. Moreover, the two vacuum grooves provide a resistive force against each other, thereby canceling any stretching or slipping of the film.

DETAILED DESCRIPTION OF PREFERRED EMBODIMENTS

Figure 1:
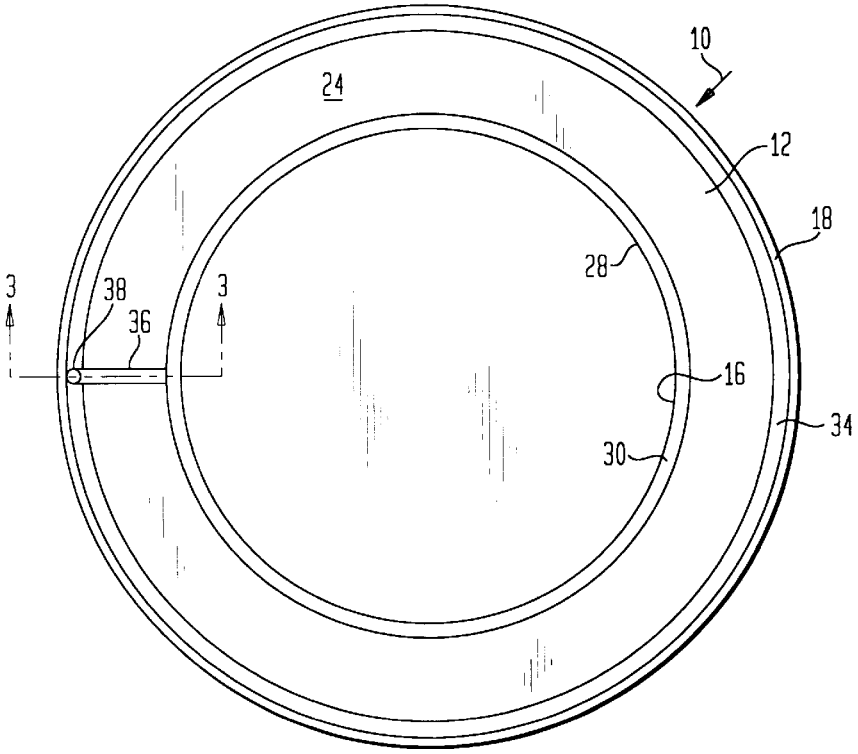
FIG. 1 is a top plan view of an adapter plate according to the invention.
Figure 2:
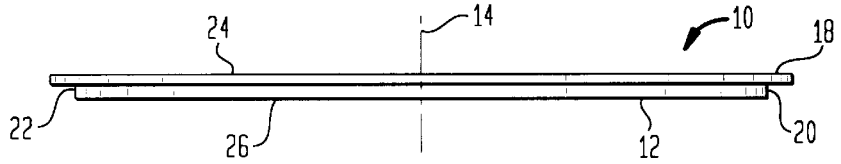
FIG. 2 is a side view of the adapter plate of FIG. 1.
Figure 3:
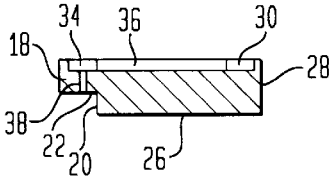
FIG. 3 is a section view taken along line 3—3 in FIG. 1.

An adapter plate 10 according to the invention is illustrated in FIGS. 1–4. The adapter plate 10 includes an annular disk 12 having an axis 14, a central aperture 16 and a flange 18 extending radially outwardly from an outer sidewall 20 of the disk 12. The flange 18 meets the outer sidewall 20 to form a shoulder 22. The disk 12 further includes a upper surface 24, a lower surface 26, and an inner sidewall 28. The upper surface 24 includes an inner annular groove 30, an outer annular groove 34, and a radial groove 36 that extends between, and communicates with, the inner and outer grooves 30, 34.

The inner groove 30 is disposed adjacent the inner sidewall 28. The outer groove 34 is disposed in the flange 18 and includes a vacuum inlet hole 38 extending downwardly from the groove 34 through the flange 18. In a preferred embodiment, the upper surface 24 is highly polished to provide a wetting surface to which a film can adhere.

Figure 5:
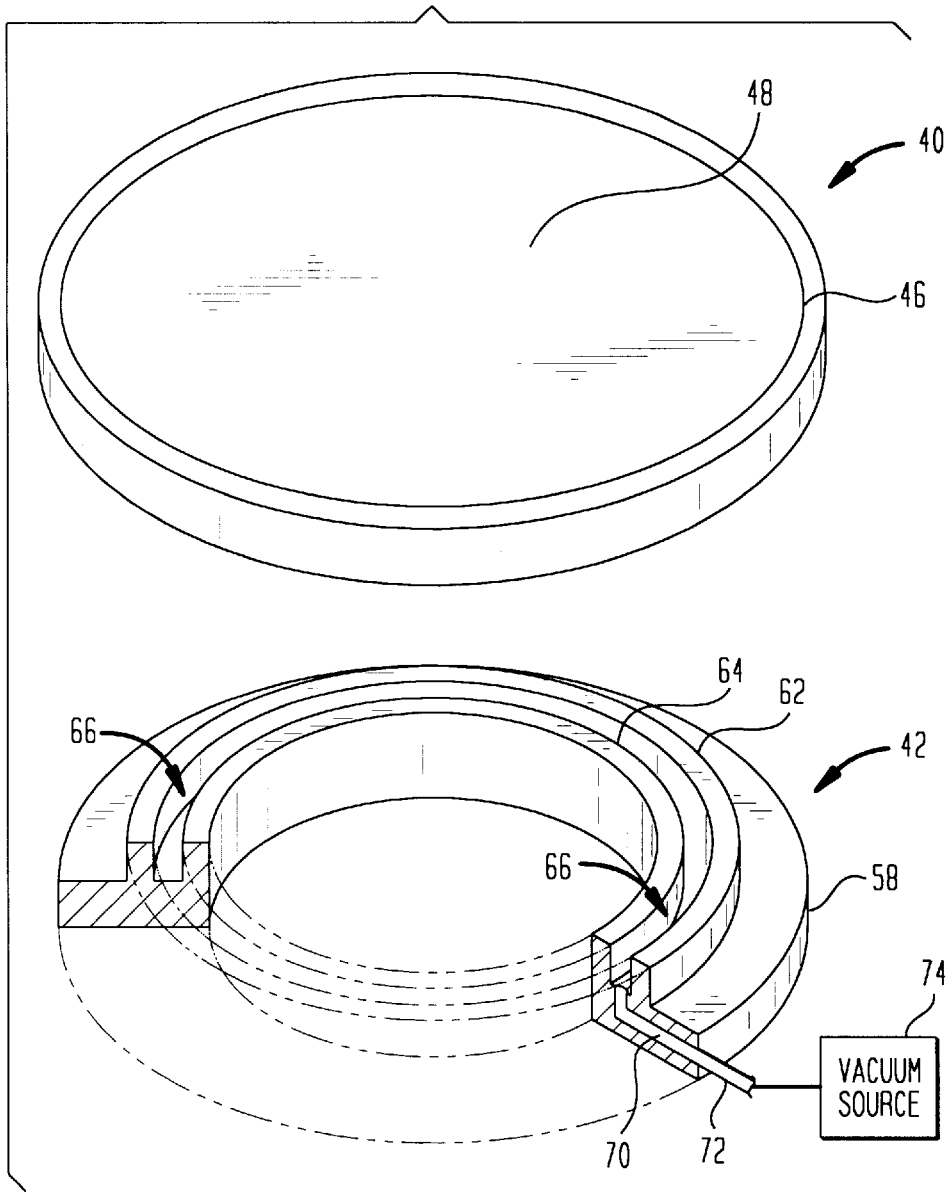
FIG. 5 is a perspective view, in partial section, of a chuck having a vacuum channel and a hoop assembly in position to be placed on the chuck.
Figure 6:
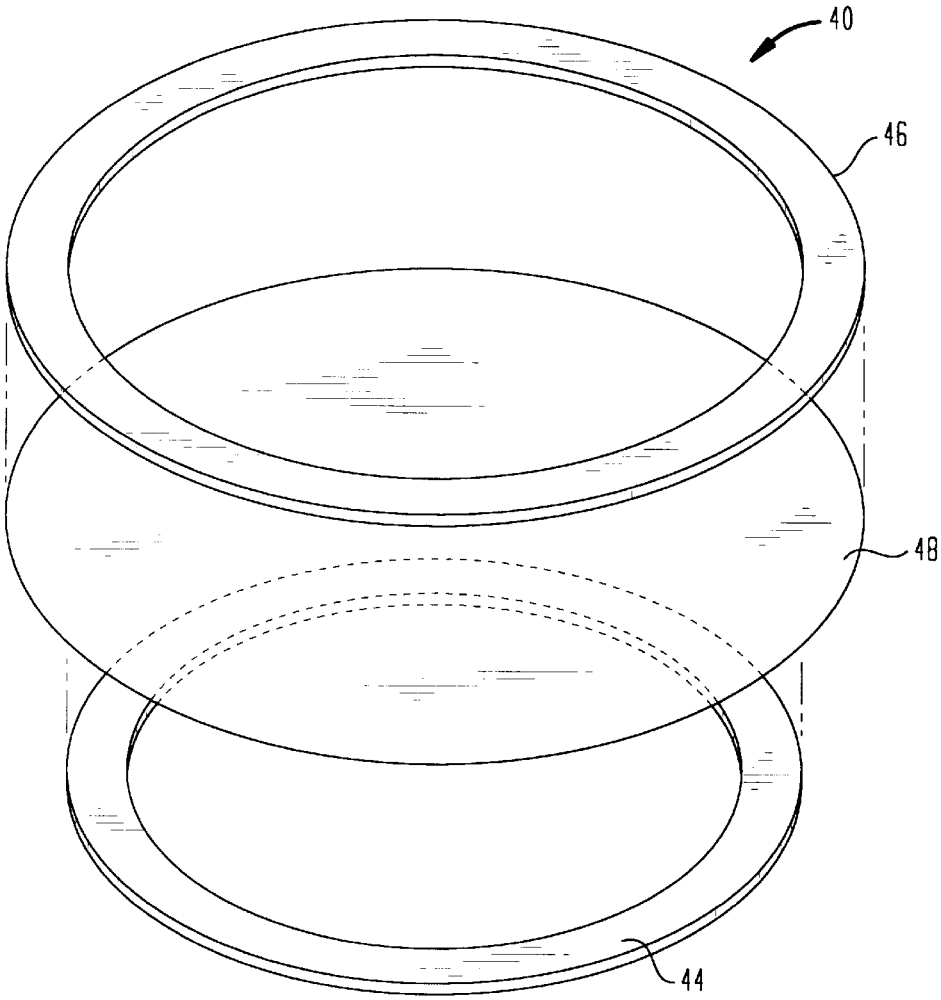
FIG. 6 is an exploded perspective view of a hoop assembly.
Figure 7:
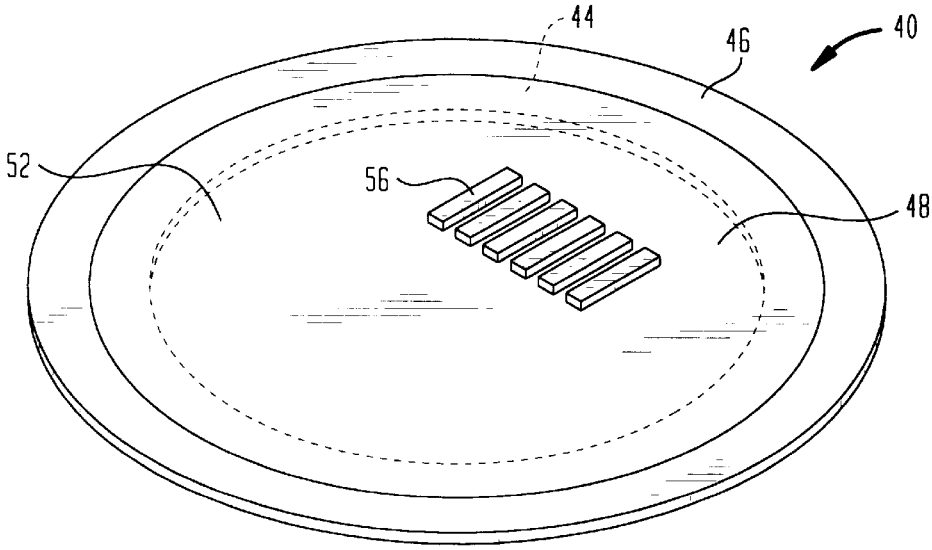
FIG. 7 is a perspective view of the hoop assembly of FIG. 6 with a plurality of laser bars mounted thereon.

The adapter plate 10 is configured to receive and support a conventional hoop assembly 40, illustrated in FIGS. 6–7, on a conventional chuck 42, illustrated in FIG. 5. The hoop assembly 40 includes an inner hoop 44, an outer hoop 46 and a polymer film 48. The inner hoop 44 includes an inner diameter 50 that is substantially equal to the outer diameter of the plate 10. The outer hoop 46 is sized to snap over the inner hoop 44, as illustrated in FIG. 7, pinching the polymer film 48 therebetween. In a preferred embodiment, the polymer film 48 includes an adhesive surface 52 for mounting the laser bars 56. Alternatively, conventional mounting tape can be applied to the film.

The conventional chuck 42 includes an annular base 58 and a pair of spaced-apart annular flanges 62, 64 extending upwardly from the base 58. The flanges 62, 64 cooperate with the base 58 to define a vacuum channel 66. A vacuum inlet 70 is formed in the base 58 to communicate with the vacuum channel 66. A vacuum source 74, coupled to the vacuum channel 66 by vacuum line 72, supplies vacuum to the vacuum channel 66.

Figure 4:
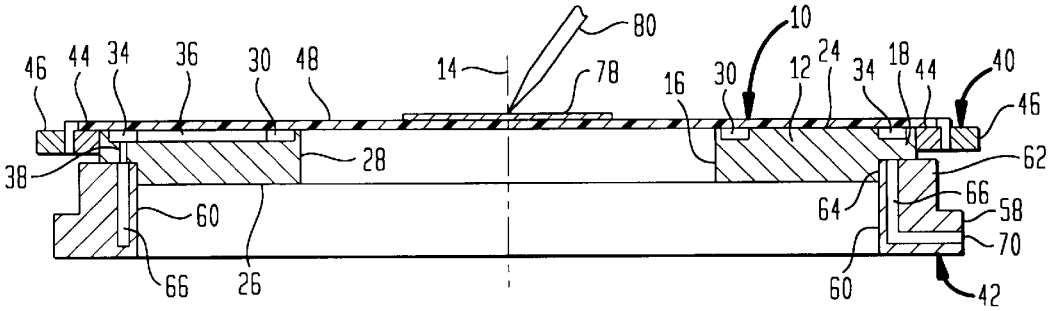
FIG. 4 is a section view taken through an adapter plate and hoop assembly mounted on a chuck.

In operation, as illustrated in FIG. 4, the adapter plate 10 is mounted on the chuck 42 with the shoulder 22 disposed against the inner sidewall 60 with the flange 18 extending over the vacuum channel 66. The vacuum inlet hole 38 is positioned to communicate with the vacuum channel 66 to apply vacuum from the vacuum channel 66 to the grooves 30, 34, 36 in the adapter plate 10. The hoop assembly 40 is mounted on the adapter plate 10 with the inner hoop 44 disposed adjacent the flange 18 and the polymer film 48 positioned on the upper surface 24 of the plate 10. A wafer, or portion of a wafer, containing laser bars 78 is mounted on the polymer film 48 and positioned under the scribing tool 80. Typically, the film is coated with an adhesive to which the material to be scribed is attached. The film provides a stable surface for scribing the wafers, even those containing laser dies, thereby increasing accuracy of the scribing process and providing a higher yield of laser dies from the wafer.

The above descriptions and drawings are only illustrative of the preferred embodiments which present the features and advantages of the present invention, and it is not intended that the present invention be limited thereto. For example, the adapter plate has been described as an annular disk. However, a solid, non-annular adapter plate that provides a wetting surface and multiple vacuum grooves for resisting movement of the film would be acceptable. Thus, any modification of the present invention which comes within the spirit and scope of the following claims is considered part of the present invention.

What is claimed is:

1. A method for scribing comprising the steps of:

mounting a film on a film holding assembly, said film holding assembly including a hoop assembly having a first hoop and a second hoop;

mounting a substrate to be scribed on the film;

mounting the film holding assembly on an adapter plate such that the first hoop is in contact with the adapter plate, the adapter plate including a first annular groove and a second annular groove;

mounting the film holding assembly and adapter plate on a scribing machine;

supplying a vacuum to said first and second annular grooves; and scribing the substrate.

2. The method of claim 1 wherein the step of mounting the film includes the step of stretching the film across the first hoop and coupling the second hoop to the first hoop to retain the film on the first hoop.

3. The method of claim 1, wherein said mounting of the film holding assembly and adapter plate on the scribing machine includes mounting the film holding assembly and adapter plate on a chuck.

4. The method of claim 3, wherein said film holding assembly and said adapter plate contact the film.

5. The method of claim 1 wherein said mounting of a substrate to be scribed is performed after said mounting of the film holding assembly and adapter plate on a scribing machine.

* * * * *